United States Patent [19]

Park et al.

[11] 3,959,534

[45] May 25, 1976

[54] PROCESS FOR PRODUCING FIBERS

[75] Inventors: Kisoon Park, Charleston; Ronald L. Readshaw, South Charleston, both of W. Va.; George H. Lourigan, Chester, S.C.

[73] Assignee: Union Carbide Corporation, New York, N.Y.

[22] Filed: Apr. 23, 1973

[21] Appl. No.: 353,503

[52] U.S. Cl. ..... 427/390; 8/115.6; 252/8.6; 252/49.3; 252/49.5

[51] Int. Cl.[2] ..... C10M 1/18; D06M 15/26

[58] Field of Search ..... 117/139.5 CQ, 139.5 A, 117/118; 252/56 R, 56 S, 49, 49.5, 11, 8.6, 49.3; 8/115.6; 427/390

[56] References Cited

UNITED STATES PATENTS

| | | | |
|---|---|---|---|
| 1,976,679 | 10/1934 | Fikentscher et al. | 8/6 |
| 2,892,791 | 6/1959 | Lowe et al. | 252/56 R |
| 3,032,538 | 5/1962 | Spaulding et al. | 252/56 R |
| 3,250,103 | 5/1966 | Beaubien | 252/56 R |
| 3,267,035 | 8/1966 | Tillman | 252/56 R |
| 3,310,428 | 3/1967 | Maloney | 117/118 |
| 3,486,929 | 12/1969 | Anspon et al. | 427/390 X |
| 3,650,664 | 3/1972 | DeGraff | 8/115.6 |
| 3,741,925 | 6/1973 | McDonald | 117/139.5 CQ |

OTHER PUBLICATIONS

Nuessle, A. C. et al., Acrylic Resins in Textile Processing, Industrial & Engineering Chemistry, Vol. 45, No. 6, June, 1953, pp. 1287–1292, TP1A58.

Taylor et al., Application of Acrylic Resins In Relation to Their Physical — Chemical Properties, Sept. 23, 1961, pp. 53–60.

*Primary Examiner*—Michael R. Lusignan
*Attorney, Agent, or Firm*—Francis M. Fazio

[57] ABSTRACT

Copolymers of ethylene with acrylic acid or methacrylic acid are used as lubricants in the high temperature, high speed production and processing of synthetic textile fibers.

3 Claims, No Drawings

PROCESS FOR PRODUCING FIBERS

BACKGROUND OF THE INVENTION

In the manufacture and processing of synthetic textile fibers, the fibers move at high speeds. During this movement they come into contact with other fibers and with the ceramic or metal surfaces of the processing equipment, e.g. pins, rollers, guides, etc. To overcome the friction it has been customary to lubricate the fibers with a fiber lubricant to reduce the frictional force; as a consequence many materials have become known that are useful in this regard. However, a problem associated with most of the known fiber lubricants is their tendency to lose their lubricating efficiency at the necessary high temperatures as the fiber speed increases, with a consequent increase in frictional force between the fiber and the ceramic or metal surface. When this frictional force is sufficiently high for the particular fiber being processed, then breakage can occur and the production process is interrupted. In some instances, the frictional force can generate sufficient heat that the fibers in the yarn can fuse together or fuse on the processing equipment. Thus, lubricants that will retain their lubricating ability at high temperature and high fiber speeds, minimize fiber breakage, minimize fiber fusion, and minimize wear of the metal or ceramic parts are in demand and being sought.

SUMMARY OF THE INVENTION

We have now found that certain known copolymers of ethylene with acrylic acid or methacrylic acid are, unexpectedly, good high temperature lubricants for the high speed production and processing of synthetic textile fibers. This was a completely unexpected and unobvious finding since this class of copolymers was developed and is widely used as an adhesive or as a pigment binder in pigmented compositions. That a recognized adhesive and binder could be used as a lubricant could not have been predicted or expected.

Significant changes in the past five years in the production and processing of fibers or filaments and yarns have occurred to meet the needs of the consumer market, such as the production of texturized fibers for special fabrics. The changes have resulted in the need to process the textile fibers and yarns at higher temperatures, as high as 200° to 250°C., and at faster processing speeds, as rapid as 450 yards per minute. Under these conditions many of the known textile fiber lubricants (mineral oils, naphthenic oils, fatty acid esters, synthetic polyethylene glycols) are not capable of performing satisfactorily. The polymers now found useful as lubricants can be utilized at these higher temperatures and processing speeds, and surprisingly it was observed that in some instances the frictional force, after reaching a maximum, decreases as the speed increases. In addition, the lubricants of this invention produced low static generation, high fiber-to-fiber friction and hence good cohesion of the textile yarns. These properties, combined with the low fiber or yarn friction to metal and the good heat stability of the polymers renders them eminently suitable as high temperature lubricants in this field. The lubricants of this invention also have low volatility and hence do not evaporate at the high processing temperatures encountered. This is shown in the following table in which the volatility of a typical ethylene/acrylyl acid copolymer is compared with various conventional fiber lubricants. In this test the volatility was determined in a forced air oven using a 3.3 gram sample and a one square inch surface with a 4 hour exposure period.

| | % Weight loss per hour 150°C. | 200°C. |
|---|---|---|
| Ethylene/acrylic acid | 0.04 | 0.28 |
| Polyethylene glycol, 6000 MW | 0.30 | 4.56 |
| TMP | 0.24 | — |
| Coconut oil | 0.16 | — |

TMP = trimethylol propane tripelargonate

DESCRIPTION OF THE INVENTION

The polymers useful as high temperature lubricants are the copolymers of ethylene with acrylic acid or methacrylic acid; in this application these polymers are designated by the term "ethylene/acrylyl acid copolymers" or variants thereof; the term "acrylyl acid" encompassing acrylic acid and methacrylic acid. The amount of acrylyl acid in the suitable copolymers can vary from 2 weight per cent to 30 weight per cent; it is preferably from 15 to 25 weight per cent. These ethylene/acrylyl acid copolymers are well known to those skilled in the art and many are commercially available in the solid form, as dispersions or emulsions, and in solution in suitable solvents. Any of the known copolymers, as defined, can be used as the high temperature lubricants.

During the processing of textile fibers, it is necessary that the fibers or yarns be lubricated to permit processing and to minimize fiber breakage. In the fiber and yarn production processes the fiber or yarn comes into contact with the metal or ceramic parts of the processing equipment, such as pins, rollers, guides, plates, etc., as the fibers or yarns slide thereover. If the frictional force between the fiber or yarn and the equipment is sufficiently high, then breakage or fusion can occur and the normal process is interrupted. To minimize friction, it is conventional to apply a lubricant to the fibers and yarns to prevent or reduce breakage or fusion. However, suitable lubricants for high speed, high temperature processing are not available. A suitable lubricant is one which can be used at modern processing conditions and that does not volatilize or decompose and deposit gummy residues on the equipment.

The ethylene/acrylyl acid copolymers are useful as fiber lubricants with fibers or yarns of the known polyesters, polyamides, the acrylics and modacrylics, acetates and triacetates, or any of the other synthetic fiber producing polymers. The fibers or yarns can be of an individual polymer or of a mixture of fiber-forming polymers. They can also be in admixture with or blended with any of the known natural fibers, cotton, silk, wool, linen, etc. Further any of the conventional additives, pigments, colorants, antioxidants, heat stabilizers, light stabilizers, delusterants, fillers, or other materials ordinarily incorporated into fibers and yarns can be present. The fiber or yarn producing polymers and the suitable conventional additives are well known to those skilled in the art and, hence, a detailed enumeration thereof in this application more extensive than that hereinbefore set foth is not necessary for a clear understanding of the invention. The invention is not the particular fiber or yarn or additive but the discovery that certain ethylene/acrylyl acid copolymers are useful lubricants in the production and processing of the synthetic fibers and yarns.

The ethylene/acrylyl acid copolymer lubricants are preferably applied to the yarn or fiber from an aqueous dispersion to obtain the low frictional properties. It was found, as shown in the examples, that use of organic solvent occasionally caused higher frictional forces. Therefor, the aqueous dispersions are preferred. In some instances, it may also be detrimental to blend another conventional lubricant with the ethylene/acrylyl acid copolymer lubricants of this invention. These deficiencies can readily be ascertained by a preliminary simple lab test. After the lubricant has been applied to the fiber or yarn, it is then processed by the conventional procedures. It was observed that the yarn-to-metal friction force of the fibers or yarns treated with our lubricants is within the same range with that of the previously used conventional fiber lubricants at very low processing speeds. This is to be expected since there is no appreciable friction developed at low speeds, nor is their any appreciable heat build-up experienced. However, at high processing speeds fibers and yarns treated with our lubricants do not show an increase in yarn-to-metal friction force, whereas those treated with the previously used conventional fiber lubricants show a continuous increase in this friction force as the processing speed is increased.

In the following examples the fibers or yarns were initially treated to remove any residual lubricant that might be present from prior processing steps. This was accomplished by extraction at 30°C. with, for example, trichloroethylene or methanol. The extracted yarns or fibers were then conditioned for at least 4 days at 70°F. and 65 per cent relative humidity. The ethylene/acrylyl acid copolymer lubricants were applied to the yarn or fiber at a lubricant add-on of 1 per cent on the weight of the fiber using conventional equipment, from an aqueous dispersion of the lubricant. After application of the lubricant, the dried yarn or fiber was conditioned for at least 4 days at a temperature of 70°F. and 65 per cent relative humidity before friction forces were determined. The lubricant dispersion can be produced by any known procedure for producing dispersions. A particularly suitable method is that set forth in U.S. Pat. No. 3,677,989, incorporated herein by reference, as are the products disclosed and described therein.

Friction force was determined using a conventional Atlab Friction Tester, and is reported in grams. High yarn-to-metal friction forces are undesirable; as are high yarn-to-yarn friction forces. The "friction force" value reported is the difference between the pre-tension and the final tension; in all measurements the pre-tension was always 5 grams. The measurements were made at the indicated temperatures, with the yarn to metal determinations made on polished chrome pins at a 180° contact angle (3.14 radians; wrap angle) and the yarn-to-yarn determinations were made at a 720° contact, which is obtained by twisting two strands of yarn together in opposite directions for two full turns. Each turn is considered a 360° angle.

The following examples serve to further describe the invention.

EXAMPLE 1

An extracted and conditioned commercially available polyester yarn, polyethylene terephthalate (150 filaments, 36 denier) was lubricated by passing the yarn at 70°F. through a 25 per cent aqueous dispersion of an 80/20 ethylene/acrylic acid copolymer, dried, and conditioned (Yarn I). For comparative purposes the same yarn was treated in the same manner with two commonly used commercial fiber lubricants, butyl stearate (Control A) and trimethylol propane tripelargonate (Control B). After conditioning, the yarn-to-yarn friction force of each at different processing speeds and at 70°F. was determined. The results are tabulated below:

| | Friction Force, grams | | |
|---|---|---|---|
| Speed,meters/min. | Yarn I | Control A | Control B |
| 1 | 20 | 10 | 10 |
| 10 | 30 | 10 | 28 |
| 100 | 28 | 45 | 120 |

The data shows the unexpected superiority of our lubricant at high processing speed. As can be seen, the ethylene/acrylic acid lubricant becomes more efficient, as shown by lower friction force values, at higher processing speeds as compared to the two conventional lubricants.

The replacement of the ethylene/acrylic acid dispersion by an aqueous dispersion of ethylene/methacrylic acid, under the same conditions gives similar results in decreasing the frictional forces during the yarn or fiber processing steps.

EXAMPLE 2

An extracted and conditioned commercially available polyamide yarn, nylon 66, (140 filaments/20 denier) was lubricated in the same manner and with a similar ethylene/acrylic acid aqueous dispersion lubricant bath as described in Example 1. The data shows low friction force values at high processing speeds at 70°F. As can be seen, the friction force showed a slight increase at low processing speeds, followed by a decrease as the processing speed was increased.

| Speed, meters/min. | Friction Force, grams |
|---|---|
| 0.1 | 12.0 |
| 1.0 | 13.5 |
| 10.0 | 37.0 |
| 30.0 | 33.0 |
| 100.0 | 26.0 |
| 200.0 | 28.0 |

EXAMPLE 3

The same polyester yarn of Example 1 was lubricated under similar conditions with a similar ethylene/acrylic acid lubricant aqueous dispersion. (Yarn I). In addition, the same yarn was lubricated with a 25 per cent solution of the same ethylene/acrylic acid in an 80/20 toluene/butanol mixture to impart the same lubricant add-on level (Control A). It was found that use of the aqueous dispersion lubricant bath significantly improved the high speed processing and low yarn-to-metal friction force values were obtained at 70°F. However, use of the organic solvent lubricant bath with the same acrylyl copolymer did not improve high speed processing; the friction force values with this medium were essentially similar to those shown by Control B of Example 1 that used a conventional lubricant. This data shows that the unexpected and unobvious improvements are obtained using aqueous dispersions but they are not obtained using organic solvent solutions or dispersions.

| Speed, meters/min. | Friction Force, Grams | |
|---|---|---|
| | Yarn I | Control A |
| 1 | 20 | 12.5 |
| 10 | 30 | 34.0 |
| 100 | 28 | 105.0 |
| 200 | — | 123.0 |

EXAMPLE 4

The effect of processing temperature on the lubricating ability of the ethylene/acrylic acid lubricants was evaluated using Yarn I and Control A of Example 3. The friction forces of these treated yarns were determined at 70°F. and at 257°F. The lubricant applied from the aqueous dispersion showed no significant change in friction force value when the yarn processing temperature was raised. However, the friction force value changed significantly at the higher temperature when the lubricant was applied from the organic medium.

| Speed, meters/min. | Friction Force, grams | | | |
|---|---|---|---|---|
| | Yarn I | | Control A | |
| | 70°F. | 257°F. | 70°F. | 257°F. |
| 10 | 30 | 30.5 | 34 | 20 |
| 100 | 28 | 29.5 | 105 | — |
| 200 | — | — | 123 | 93 |

EXAMPLE 5

An aqueous dispersion containing about 40 weight per cent of an 88/12 ethylene/methacrylic acid copolymer was prepared and used to lubricate the same polyester yarn described in Example 1; following that procedure. This lubricant showed low yarn-to-metal friction force values at high processing speeds.

| Speed, meters/min. | Friction Force, grams |
|---|---|
| 1 | 9 |
| 10 | 30 |
| 100 | 25 |

EXAMPLE 6

The effect of the addition of a known lubricant, polyethylene glycol of about 400 molecular weight, to the lubricant of this invention was evaluated and it was observed that in this instance this addition had an adverse effect on the yarn-to-metal friction force. The polyester yarn was lubricated with the aqueous ethylene/acrylic acid dispersion of Example 1 as therein described (Yarn I). In addition, an aqueous dispersion was prepared containing a 70/30 mixture of the same ethylene/acrylic acid copolymer and the polyethylene glycol and this was used to lubricate another portion of the polyester yarn (Yarn II). As will be seen from the data, Yarn I had much lower yarn-to-metal friction force values.

| Speed, meters/min. | Friction Force, grams | |
|---|---|---|
| | Yarn I | Yarn II |
| 1 | 20 | 28 |
| 10 | 30 | 83 |
| 100 | 28 | 119 |

While the yarn-to-metal friction force was increased, the addition of the polyethylene glycol did reduce the yarn-to-yarn friction forces.

What we claim is:

1. In a method for manufacturing or processing synthetic textile fibers comprising applying an effective amount of lubricants to the surface of said fibers, the improvement consisting of using aqueous dispersions of ethylene/acrylic acid or ethylene/methacrylic acid copolymers as the lubricants.

2. A method as claimed in claim 1 wherein said copolymer is ethylene/acrylic acid.

3. A method as claimed in claim 1 wherein said copolymer is ethylene/methacrylic acid.

* * * * *